US006176231B1

(12) United States Patent
Smith

(10) Patent No.: US 6,176,231 B1
(45) Date of Patent: Jan. 23, 2001

(54) CABLE GUARD FOR COMPOUND ARCHERY BOWS

(75) Inventor: Allan F. Smith, Tucson, AZ (US)

(73) Assignee: Precision Shooting Equipment, Inc., Tucson, AZ (US)

( * ) Notice: Under 35 U.S.C. 154(b), the term of this patent shall be extended for 0 days.

(21) Appl. No.: 09/574,029

(22) Filed: May 19, 2000

(51) Int. Cl.[7] ..... F41B 5/10
(52) U.S. Cl. ..... 124/25.6
(58) Field of Search ..... 124/23.1, 25.6, 124/86, 88

(56) References Cited

U.S. PATENT DOCUMENTS 4,377,152 * 3/1983 Saunders ..... 124/88
4,452,222 * 6/1984 Quartino et al. ..... 124/23.1
5,433,792 * 7/1995 Darlington ..... 124/25.6
5,911,215 * 6/1999 Fisher ..... 124/86

* cited by examiner

*Primary Examiner*—John A. Ricci
(74) *Attorney, Agent, or Firm*—Cahill, Sutton & Thomas, P.L.C.

(57) ABSTRACT

One end of a cable guard for an archery bow is received in a bore in the bow riser. The bore is substantially parallel to the plane of the drawstring. A hole in the riser transverse to the plane of the drawstring houses two clamp members in engagement with the end portion of the cable guard. A bolt extending through one clamp member and threadably received in the other clamp member draws the clamp members toward each other to frictionally clamp the cable guard in place.

3 Claims, 2 Drawing Sheets

CABLE GUARD FOR COMPOUND ARCHERY BOWS

TECHNICAL FIELD

This invention is concerned with the mounting of a cable guard on a compound archery bow.

BACKGROUND ART

Compound archery bows are those in which a cam or wheel is mounted at the free ends of the bow limbs and a cable is run back and forth over the cams or wheels. There are usually three runs of the cable all lying in the same plane. Only the rearmost cable run functions as a drawstring and means must be provided to position the other cable runs out of the path of the arrow. This means is referred to as a "cable guard", or a "spreader".

The cable guard is customarily mounted on the bow riser either above or below the handle and extends rearwardly to the forward cable runs. Most prior art guard mounting arrangements required threaded holes in the bow riser which were difficult to repair if damaged and frequently required replacement of the entire riser—an expensive repair.

There continues to be a need for a cable guard mounting arrangement which is simple, attractive and economical to repair.

SUMMARY OF THE INVENTION

One end of the cable guard is housed in a smooth bore machined in the bow riser. The axis of the bore is substantially parallel to the plane of the drawstring. A transverse hole through the riser is provided to house two clamp members in positions to engage the housed end portion of the guard. A bolt extending through one of the clamp members is threadably received in the other clamp member and draws the clamp members toward each other and into frictional engagement with the housed portion of the guard. The outer surfaces of the clamp members are preferably flush with or recessed with respect to those surfaces of the riser in the vicinity of the hole.

BRIEF DESCRIPTION OF THE DRAWINGS

The invention is described in greater detail hereafter by reference to the accompanying drawings wherein.

BEST MODE FOR CARRYING OUT THE INVENTION

Figure 1:
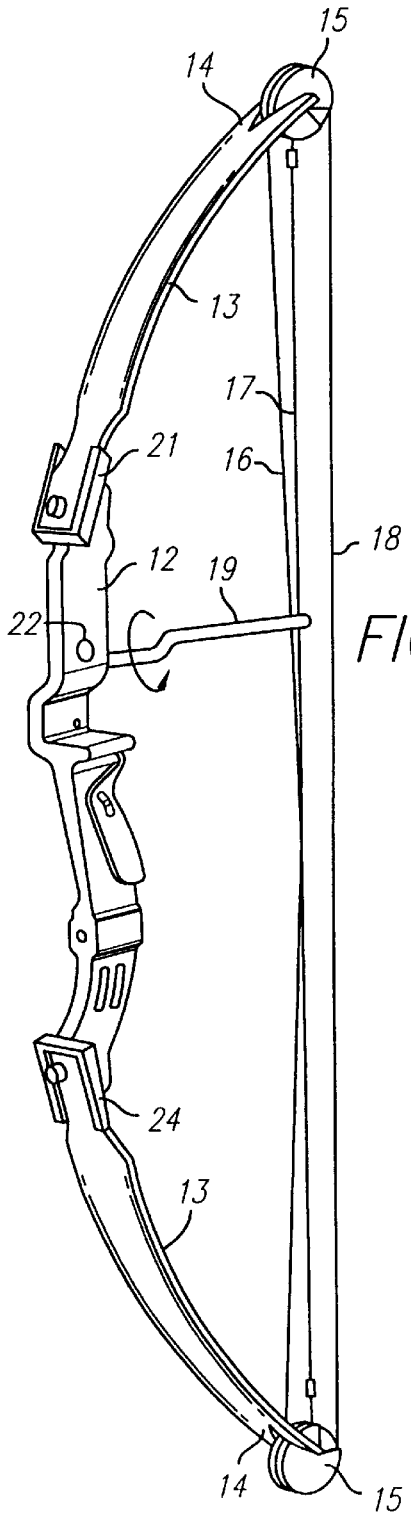
FIG. 1 is a perspective view of a compound bow incorporating the invention.
Figure 2:
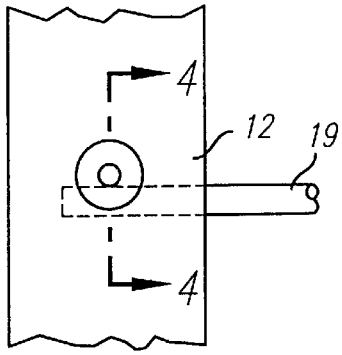
FIG. 2 is an enlarged side view of that portion of the bow riser to which a cable guard is mounted.
Figure 3:
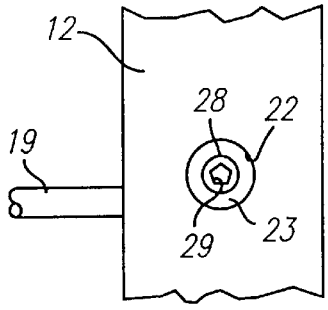
FIG. 3 is a view similar to FIG. 2 of the opposite side of the riser.

In FIG. 1 reference numeral 10 identifies generally a compound archery bow embodying the invention. The bow 10 illustrated is of conventional construction and includes a riser 12 which also functions as a handle. Mounted on the upper and lower ends of the riser 12 are flexible limbs 13 the free ends 14 of which carry wheels, or cams, 15. The bow 10 is strung with three runs of cable 16, 17 and 18 secured to the limbs 13 and passing over the wheels 15 in a manner well known in the art.

Cable run 18 serves as a bowstring for propelling an arrow. To avoid interference with the arrow and its flight in leaving the bow the forward cable runs 16 and 17 must be displaced from the plane of the bowstring run 18 in the vicinity of the arrow. This is accomplished by what is known as a cable guard, or spreader, indicated by reference numeral 19. Cable guard 19 is customarily mounted on the riser 12 either above (as shown in FIG. 1) or below the handle portion of the riser. This invention is concerned with the mounting of the cable guard 19.

A smooth bore 21 is provided in the riser 12 to receive an end portion of the cable guard 19. The axis of the bore 21 is substantially parallel to the plane of bowstring run 18. A transverse hole 22 in the riser 12 holds two clamp members 23 and 24 next to that portion of the cable guard 19 which is positioned within bore 21. A bolt 26 passes through clamp member 23 and is threadably received in clamp member 24. The outer face of clamp member 23 is preferably recessed at 27 to receive the head 28 of bolt 26. And the head 28 of the bolt 26 has a recess therein for receiving a tool for tightening and loosening bolt 26. This recess is preferably a hexagonal socket.

The lower inner faces of clamp members 23 and 24 are preferably shaped at 31 and 32, respectively, to conform to the surface of cable guard 19 which they contact. Thus, when bolt 26 is tightened to draw clamp members 23 and 24 toward each other and into frictional contact with cable guard 19, contact is over a substantial surface area of the cable guard. This assures that the cable guard 19 is not damaged when clamped tightly between clamp members 23 and 24.

If the cable guard is provided with an offset as shown in FIG. 1 its lateral position can be changed by loosening bolt 26 and turning the guard about the portion in bore 21. Frictional contact between the clamp members 23 and 24 and the cable guard when the bolt 26 is tightened prevents the guard from shifting positions accidently.

There are several beneficial features to this mounting arrangement hose.

First, the machining required for the riser 12 is minimal simple drilling for both bore 21 and hole 22. There are no threads in either bore 21 or hole 22 to become damaged.

Secondly, the bolt 26 and clamp members 23 and 24 are simple machined parts easily and inexpensively replaced if damaged in use. And as mentioned above the possibility of damage to the cable guard 19 from clamping is nil.

Figure 4:
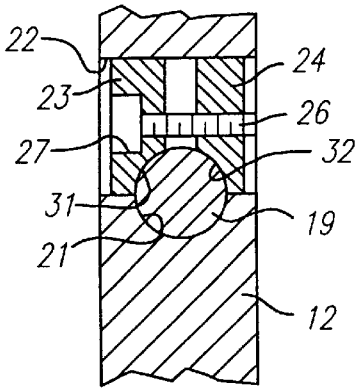
FIG. 4 is a sectional view taken as indicated by line 4—4 in FIG. 2.
Figure 5:
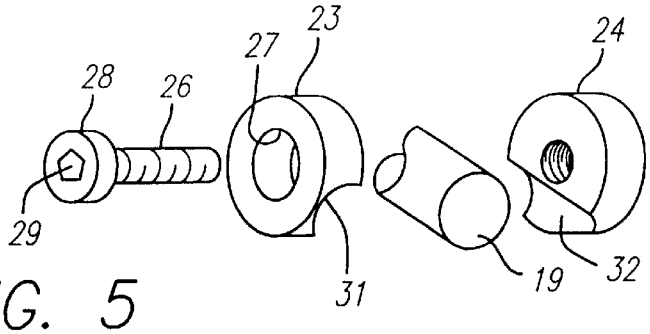
FIG. 5 is an exploded perspective view of the cable guard mounting components.
Figure 6:
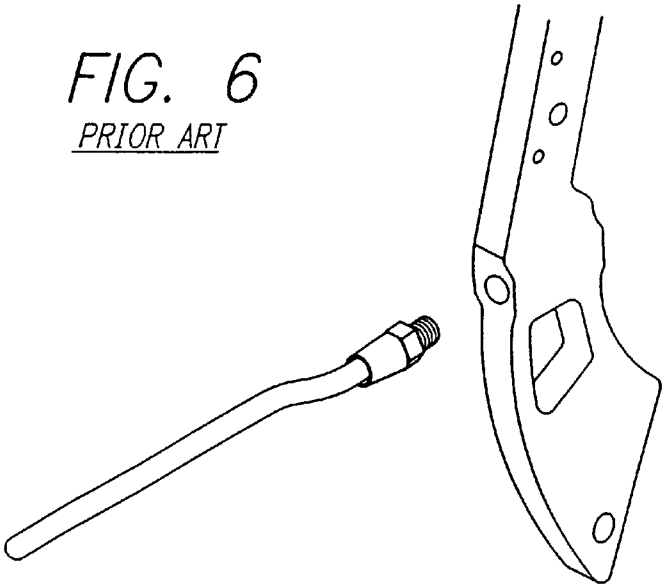
FIG. 6 PRIOR ART
FIGS. 6 through 9 illustrate prior art mounting arrangements.
Figure 7:
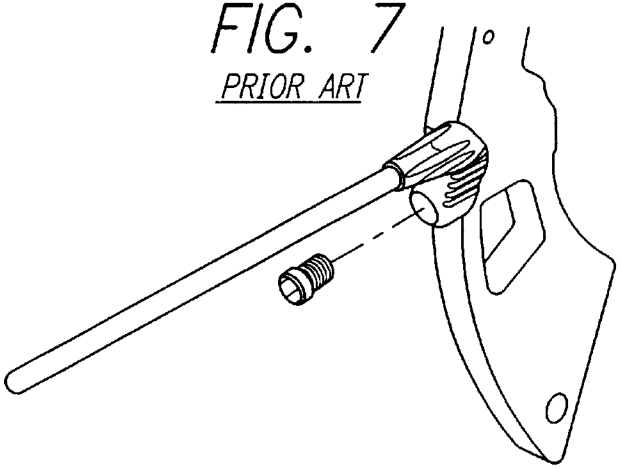
FIG. 7 PRIOR ART
Figure 8:
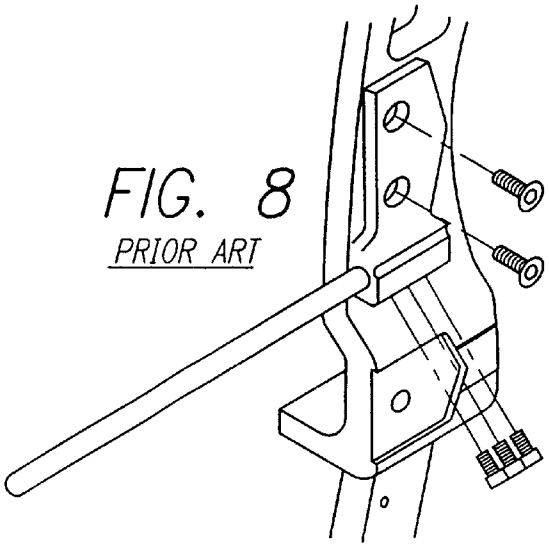
FIG. 8 PRIOR ART
Figure 9:
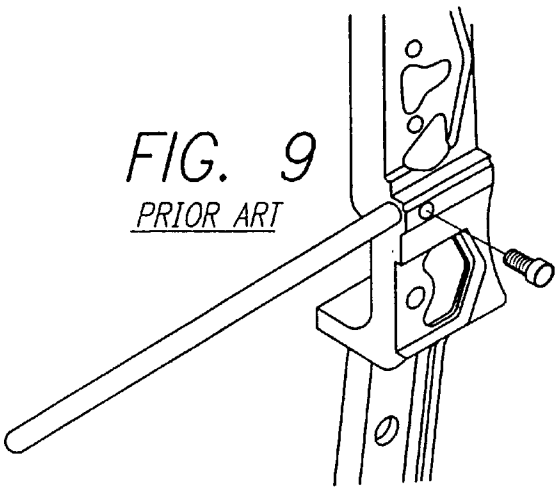
FIG. 9 PRIOR ART

Lastly, the mounting arrangement is pleasing in appearance. As best seen in FIG. 4, the clamping members 23 and 24 and the bolt 26 do not protrude beyond the surface of the riser 12 in the vicinity of hole 22.

These features contrast with the prior art mounting arrangements illustrated in FIGS. 6 through 9. In all of these mounting arrangements the riser has threaded openings which are subject to damage. In addition in the mounting arrangement of FIGS. 8 and 9 the cable guard can be damaged by overtightening set screws.

What is claimed is:

1. In a compound archery bow comprising a riser, a limb connected to each end of the riser, multiple runs of a cable between the free ends of the limbs, one of which cable runs serves as a drawstring, and a cable guard mounted on the riser and engaging the cable runs other than the drawstring, the improvement comprising a bore extending forwardly in said riser, said bore being sized to closely receive an end portion of the cable guard, a hole extending through said riser transverse to the plane of the drawstring, oppositely disposed clamp members disposed in said hole and engageable with a portion of said cable guard in said bore, and a bolt passing through one of said clamp members and threadably received in the other of said clamp members, said bolt when tightened causing said clamp members to frictionally engage and hold said cable guard in position.

2. The archery bow of claim 1 wherein neither of said clamp members nor said bolt project beyond the surface of the riser in the vicinity of said hole.

3. The archery bow of claim 1 wherein each of said clamp members is shaped like the surface region of the cable guard with which it engages.

* * * * *